US005338403A

United States Patent [19]

Pedersen

[11] Patent Number: 5,338,403

[45] Date of Patent: Aug. 16, 1994

[54] HYDROLYSIS OF RESIN IN PULP WITH AN ENZYME AND A HYDROSULFITE

[75] Inventor: Lars S. Pedersen, Lyngby, Denmark

[73] Assignee: Novo Nordisk A/S, Bagsvaerd, Denmark

[21] Appl. No.: 983,521

[22] PCT Filed: Oct. 17, 1991

[86] PCT No.: PCT/DK91/00315

§ 371 Date: Mar. 3, 1993

§ 102(e) Date: Mar. 3, 1993

[87] PCT Pub. No.: WO92/07138

PCT Pub. Date: Apr. 30, 1992

[30] Foreign Application Priority Data

Oct. 17, 1990 [DK] Denmark ..... 2499/90

[51] Int. Cl.[5] ..... D21C 9/10

[52] U.S. Cl. ..... 162/72; 162/83; 435/277; 435/278

[58] Field of Search ..... 435/277, 278; 162/72, 162/83

[56] References Cited

U.S. PATENT DOCUMENTS

| | | | |
|---|---|---|---|
| 3,486,969 | 12/1969 | Nilsson et al. | 162/72 |
| 4,922,989 | 5/1990 | Backlund et al. | 162/24 |

FOREIGN PATENT DOCUMENTS

| | | | |
|---|---|---|---|
| 45822/89 | 6/1990 | Australia . | |
| 0374700 | 12/1988 | European Pat. Off. . | |
| 124193 | 3/1972 | Norway . | |
| WO88/03190 | 3/1980 | PCT Int'l Appl. | 162/72 |
| WO91/07542 | 11/1989 | PCT Int'l Appl. . | |

*Primary Examiner*—Steve Alvo

*Attorney, Agent, or Firm*—Steve T. Zelson; Elias J. Lambiris

[57] ABSTRACT

Resin can be hydrolyzed enzymatically during the reductive bleaching (e.g. with sodium dithionite) commonly used in pulp manufacture. The enzyme treatment necessitates little or no change of commonly used bleaching conditions.

13 Claims, 1 Drawing Sheet

Temperature: 60 deg. C

HYDROLYSIS OF RESIN IN PULP WITH AN ENZYME AND A HYDROSULFITE

TECHNICAL FIELD

This invention relates to a process for hydrolysis of resin in pulp.

BACKGROUND ART

Mechanical pulping, alone or combined with a gentle chemical treatment, is widely used in the manufacture of pulps. These processes occur at pH in the range 4–9, and the components of the wood undergo relatively small chemical changes. The pulp therefore has a considerable content of triglycerides, esters and waxes from resin.

Residual resin may cause problems during the subsequent use of the pulp. Thus, agglomerated resin may cause paper breakage during paper manufacture or during printing as well as lowering the paper quality. It is known that the hydrophobic part of resin contains considerable amounts of triglycerides and other esters. It would be desirable to hydrolyze these as the hydrolysis products are more easily removed in aqueous systems.

GB 1,189,604 discloses a process for removing resin constituents from wood chips by applying microorganisms to wood chips during storage. However, decomposition of resin by growth of microorganisms is very difficult to control; temperature, residence time, microbial flora etc. may fluctuate, and the microorganisms may secrete cellulase and hemicellulase that decreases fibre strength and yield.

It is the object of the invention to provide a controllable process for reducing the resin content of pulp with minimal changes of existing equipment and process conditions.

SUMMARY OF THE INVENTION

We have found that, surprisingly, resin can be hydrolyzed enzymatically during the reductive bleaching (e.g. with sodium dithionite) commonly used in pulp manufacture. The enzyme treatment necessitates little or no change of commonly used bleaching conditions.

Accordingly, the invention provides a process for hydrolysis of resin in pulp, characterized by carrying out enzymatic hydrolysis of resin simultaneously with reductive bleaching of the pulp.

DETAILED DESCRIPTION OF THE INVENTION

Pulp

Figure 1:
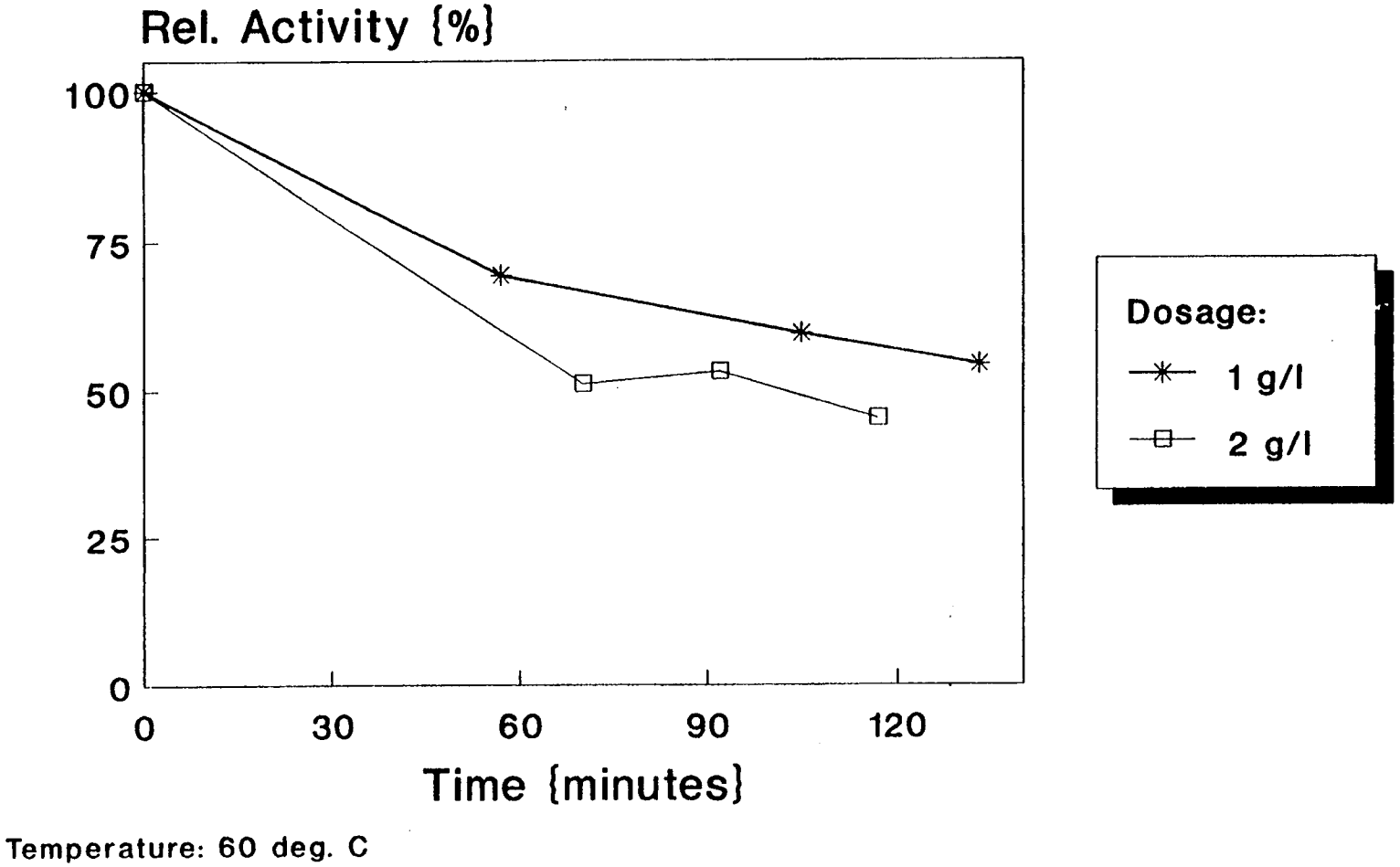
FIGURE 1 shows the stability of lipase towards sodium dithionite.

The process of the invention may be applied to any resin-containing pulp, especially to pulps with a considerable content of triglycerides, esters and waxes from resin. Examples are pulps produced by mechanical pulping, alone or combined with a gentle chemical treatment, such as GW (Ground Wood), TMP (Thermo Mechanical Pulp) and CTMP (Chemical Thermo Mechanical Pulp).

Enzyme

The process of the invention uses an enzyme to hydrolyze the triglycerides and/or other esters in the resin, i.e. an enzyme with lipase and/or esterase activity. For obvious reasons, the enzyme to be used should be active and reasonably stable at the process conditions to be used; especially temperature, pH and the presence of reductive bleaching agents affect the enzyme stability. More specifically, enzyme and process conditions are preferably chosen such that at least 10% of the enzyme activity remains after the reaction, and preferably more than 50% activity remains after 40 minutes.

Examples of suitable enzymes are lipases derived from strains of Pseudomonas (especially *Ps. cepacia, Ps. fluorescens, Ps. fragi* and *Ps. stutzeri*) Humicola (especially *H. brevispora*), Candida (especially *C. antarctica*), *H. lanuginosa, H. brevis* var. thermoidea and *H. insolens*), Chromobacter (especially *C. viscosum*) and Aspergillus (especially *A. niger*). An example of a commercial lipase preparation is Resinase TM A, product of Novo Nordisk A/S.

The enzyme dosage required for significant resin hydrolysis depends on process conditions, but is generally above 0.1 KLU/kg of pulp dry matter (KLU = 1000 Lipase Units, defined in WO 89/04361), preferably 0.5–150 KLU/kg.

To avoid break-down of the fibre structure in the pulp, cellulase side-activities should be essentially absent, preferably below 1000 EGU/kg of pulp dry matter (EGU unit for cellulase activity defined in WO 91/07542).

Reductive bleaching

The process of the invention includes bleaching with a reductive bleaching agent which may be hydrosulfites; e.g. sodium- or zinc-dithionite, sodium borohydride or sodium bisulphite.

For e.g. sodium dithionite the concentration used in a normal reductive bleaching is typically in the range of 0.05 to 5.0% by weight on dry pulp matter.

Process conditions

Conventional conditions for reductive pulp bleaching may be used. Typically, pH will be in the range 3–7 throughout the reaction. Other additives commonly used in reductive bleaching may be present, such as sodium polyphosphate, sodium bicarbonate and complexing agents (e.g. EDTA, DTPA, STPP).

The bleaching temperature is in the range 40°–90° C., normally 50°–70° C. and the reaction time is in the range 0.5–5.0 hours, normally around 3 hours.

The consistency of the pulp is in the range 2–30%, typically 3–8%.

Optional additional process steps

Conventional reductive bleaching is generally followed by a draining off of the bleach liquor and washing of the bleached pulp. One bleaching stage may be followed by other stages. This can be e.g. one or more reductive bleaching stages or one or more oxidative bleaching stages using peroxy bleaching agents or combinations of oxidative and reductive bleaching stages.

The lipase may, of course, be introduced in one or more of these optional stages, both in reductive and oxidative stages.

EXAMPLE 1

The stability of a commercial lipase product at reductive bleaching conditions was tested as follows.

To two aqueous phosphate buffer (0.02 molar) solutions having a pH of 6.0, 1 g/l and 2 g/l, respectively, of sodium dithionite were added. To these solutions a commercial liquid lipase formulation (Resinase TM A, product of Novo Nordisk A/S) was added.

The lipase activity in the solution was measured during the next approx. 2.5 hours. Relative activities are listed in table 1 and 2 and plotted versus time in FIG. 1. The relative activity is defined as the activity at a given time in percent of the initial lipase activity. The absolute activity have been measured in KLU-units according to the analytical procedure AF 95/5, available on request from Novo Nordisk A/S.

The results show that the lipase is fairly stable towards sodium dithionite. The performance of the lipase over 133 minutes, which is measured as the area under the curve plotted in FIG. 1, is only decreased by 28.5% and 35.4% by the addition of 1.0 g/l and 2 g/l of sodium dithionite, respectively, compared to no addition of sodium dithionite.

It is seen that the enzyme is fairly stable at these typical bleaching conditions, with a half-life above 90 minutes, and more than 40% residual activity after 2 hours reaction time.

TABLE 1

| (1 g/l sodium dithionite at 60° C.) | |
|---|---|
| Time minutes | Relative activity % |
| 0 | 100 |
| 57 | 69.3 |
| 105 | 59.5 |
| 133 | 54.3 |

TABLE 2

| (2 g/l sodium dithionite at 60° C.) | |
|---|---|
| Time minutes | Relative activity % |
| 0 | 100 |
| 70 | 51.0 |
| 92 | 53.0 |
| 117 | 45.3 |

EXAMPLE 2

This experiment is equal to Example 1 except for the lipase used. For this experiment a commercial thermostable lipase formulation (Novozym 429, product of Novo Nordisk A/S, lipase A from *C. antarctica*, described in WO 88/02775) was used.

This enzyme is very stable towards dithionite. The activity of the enzyme was not reduced at all by the addition of 1.0 g/l and 2.0 g/l of sodium dithionite compared to no addition of sodium dithionite.

EXAMPLE 3

The lipase used in Example 1 was added to a groundwood pulp. The amount of lipase added corresponded to a dosage of 100 KLU/kg of dry pulp. The lipase was added during a sodium dithionite bleaching. The bleaching conditions were 60° C., at a consistency of 4.5%, a bleaching time of 2 hours and an initial pH of 6.0.

The following amounts of bleaching chemicals were added 1.54% (w/w) sodium dithionite and 0.5% (w/w) EDTA on dry pulp.

Three control experiments were made. One with no addition of bleaching chemical and enzyme, one without addition of bleaching chemicals and the last one without addition of enzyme.

The table below shows the increase of pulp brightness (measured as % (ISO) brightness as well as reduction of the triglycerides content of the pulp.

TABLE 3

| Enzyme Addition | Bleaching Chemical addition | Brightness % (ISO) | Reduction of Triglycerides % |
|---|---|---|---|
| No | No | 62.6 | — |
| No | Yes | 66.5 | 12.5 |
| Yes | No | 62.5 | 62.5 |
| Yes | Yes | 66.2 | 58.8 |

It is observed that both the bleaching system and the lipase work well at the same time. The dithionite bleaching works equally well with and without the presents of a lipase. The same was the case for the lipase. It hydrolyzes approximately the same amount of triglycerides both with and without the presence of bleaching chemicals.

EXAMPLE 4

A pulp is processed according to the invention as follows:

The lipase used in Example 1, is added to a TMP pulp. The amount of lipase added corresponds to a dosage of 25 KLU per kg of pulp. The lipase is added during a traditional sodium dithionite bleaching to a final brightness of 60% ISO-brightness.

The lipase treatment results in a reduction of the amount of triglycerides in the bleached pulp compared to a pulp which has not been treated with enzyme. The amount of triglycerides in the pulp is reduced by more than 80%. The lipase catalyzed hydrolysis of the triglycerides gives an increase in the amount of the more hydrophilic mono-glycerides and fatty acids, which can be removed more easily in the washing stages after the bleaching.

I claim:

1. A process for hydrolysis of resin in pulp during bleaching of the pulp, comprising enzymatically hydrolyzing the resin with an enzyme selected from the group consisting of lipase and esterase simultaneously with the bleaching of the pulp with a hydrosulfite, wherein the enzyme and the hydrosulfite agent are present during the bleaching in amounts effective to hydrolyze resin in the pulp and bleach the pulp.

2. A process according to claim 1, wherein the pulp consistency is 2–30% by weight.

3. A process according to claim 2, wherein the pulp consistency is 3–10% by weight.

4. A process according to claim 1, wherein the enzyme is a microbial lipase, derived from strain of Candida, Pseudomonas, Humicola, Chromobacter or Aspergillus.

5. A process according to claim 4, wherein the microbial lipase is present at an activity of 0.5–150 KLU/kg of pulp dry matter.

6. A process according to claim 5, wherein the microbial lipase is present at an activity of 20–75 KLU/kg of pulp dry matter.

7. A process according to claim 1, wherein the hydrolysis is carried out at a cellulase activity which is below 1000 EGU/kg of pulp dry matter.

8. A process according to claim 1, wherein the reductive bleaching agent is sodium dithionite.

9. A process according to claim 1, wherein the hydrosulfite is present at a concentration of 0.05–5% by weight of pulp dry matter calculated as sodium dithionite.

10. A process according to claim 1, wherein the hydrolysis is carried out at a pH of 3–7.

11. A process according to claim 1, wherein the hydrolysis is carried out at a temperature of 40°–90° C.

12. A process according to claim 1, wherein the hydrolysis is carried out for a reaction time of 0.5–5.0 hours.

13. A process according to claim 1, further comprising subsequently draining and washing of the pulp.

* * * * *